US007735168B2

(12) United States Patent
Derenne et al.

(10) Patent No.: US 7,735,168 B2
(45) Date of Patent: Jun. 15, 2010

(54) PATIENT SUPPORT APPARATUS WITH REMOVABLE FOOT SECTION

(75) Inventors: Richard A. Derenne, Portage, MI (US); Christopher Gentile, Sturgis, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 12/193,421

(22) Filed: Aug. 18, 2008

(65) Prior Publication Data

US 2008/0307579 A1 Dec. 18, 2008

Related U.S. Application Data

(62) Division of application No. 11/004,703, filed on Dec. 3, 2004, now Pat. No. 7,412,739.

(51) Int. Cl.
*A61G 7/00* (2006.01)

(52) U.S. Cl. ..... 5/602; 5/624; 5/731

(58) Field of Classification Search ..... 6/602, 6/624, 620–621; 5/602, 624, 620–621
See application file for complete search history.

(56) References Cited

U.S. PATENT DOCUMENTS

| | | | | |
|---|---|---|---|---|
| 2,275,973 | A | 3/1942 | Marchbanks | |
| 2,552,370 | A | 5/1951 | Curtis | |
| 2,605,151 | A | 7/1952 | Shampaine | |
| 3,492,679 | A | 2/1970 | Drew | |
| 4,025,972 | A | 5/1977 | Adams et al. | |
| 4,097,939 | A | 7/1978 | Peck et al. | |
| 4,139,917 | A | 2/1979 | Fenwick | |
| 4,225,127 | A | 9/1980 | Strutton | |
| 4,411,035 | A | 10/1983 | Fenwick | |
| 4,428,608 | A | 1/1984 | Cooke et al. | |
| 4,639,954 | A | 2/1987 | Speed | |
| 4,860,394 | A | 8/1989 | Benessis et al. | |
| 4,894,876 | A | 1/1990 | Fenwick | |
| 5,148,562 | A | 9/1992 | Borders et al. | |
| 5,157,800 | A | 10/1992 | Borders | |
| 5,214,812 | A | 6/1993 | Bartow et al. | |
| 5,226,187 | A | 7/1993 | Borders et al. | |
| 5,329,657 | A | 7/1994 | Bartley et al. | |
| 5,423,097 | A | 6/1995 | Brule et al. | |
| 5,667,261 | A | 9/1997 | Weinerman et al. | |
| 5,774,914 | A | 7/1998 | Johnson et al. | |
| 5,926,878 | A | 7/1999 | Morton et al. | |
| 6,654,974 | B2 | 12/2003 | Ruehl et al. | |
| 6,757,924 | B2 * | 7/2004 | Goodwin et al. | 5/602 |
| 7,127,756 | B2 | 10/2006 | Brophy et al. | |

OTHER PUBLICATIONS

Stryker Adel 2100 Childbearing Bed, Service Manual, 1988, pp. 1-28.

(Continued)

*Primary Examiner*—Fredrick Conley
(74) *Attorney, Agent, or Firm*—Van Dyke, Gardner, Linn & Burkhart, LLP

(57) ABSTRACT

A patient support apparatus includes a patient support, a removable section configured for movement to a position wherein the removable section is aligned with patient support wherein the removable section can be coupled to the patient support, a second position wherein the removable section is adjacent to, but spaced from the first position and a third position spaced apart from the patient support. The patient support apparatus further includes a locking mechanism that is configured to sense when the removable section is properly aligned with the patient support so that the removable section can be mounted to the patient support.

19 Claims, 17 Drawing Sheets

OTHER PUBLICATIONS

Stryker Adel 500XL Childbearing Bed, Service Manual 1986 pp. 1-16.

Stryker Adel 2100 EC Childbearing Bed, Ultimate convenience and comfort, Jan. 1994 (6 pages).

Stryker Adel 500XL Childbearing Bed, May 1995 (2 pages).

Stryker Medical, Labor & Delivery Model 5000 Series, Oct. 1996 (2 pages).

* cited by examiner

PATIENT SUPPORT APPARATUS WITH REMOVABLE FOOT SECTION

CROSS-REFERENCE TO RELATED APPLICATION

This application is a divisional application of U.S. patent application Ser. No. 11/004,703, filed Dec. 3, 2004, entitled PATIENT SUPPORT APPARATUS WITH REMOVABLE FOOT SECTION, by Applicants Richard A. Derenne and Christopher Gentile, which is now U.S. Pat. No. 7,412,739, issuing Aug. 19, 2008.

FIELD OF THE INVENTION

The invention relates to a patient support apparatus with a removable foot section. In one of its aspects, the invention relates to a removable foot section provided with a positive locking mechanism provided with a convenient handle for use in attachment and removal of the removable foot section by an operator.

BACKGROUND OF THE INVENTION

A patient support apparatus with a removable foot section, also known in the field as a birthing bed, provides full support for a patient, namely an expectant mother in labor, until she is ready to give birth. Rather than move the mother to another bed that gives the doctor better access, the birthing bed is provided with a removable foot section. This removable foot section must be capable of ready detachment, but just as importantly must be positively secured to the main bed and incapable of inadvertent detachment. It would further be advantageous to provide a removable foot section with an operating mechanism that does not extend beyond the normal profile of the bed, and is intuitive to the operator in its method of operation.

SUMMARY OF THE INVENTION

A patient support apparatus includes a patient support having a first patient support deck, a removable section having a second patient support deck, the removable section being configured for movement to a first position wherein the removable section is coupled to the patient support, a second position wherein the removable section is adjacent to but spaced from the first position and a third position spaced apart from the patient support. A handle support mechanism is mounted on one of the patient support and the removable section. A handle is movably mounted on the handle support mechanism and is supported thereby for movement between a first handle position and a second handle position. The handle support mechanism is configured to facilitate movement of the handle from the first handle position toward the second handle position only when the removable section is oriented at and between the first and second positions.

In a further embodiment of the invention, a patient support apparatus comprises a patient support including a first patient support deck, a removable section having a second patient support deck, the removable section being configured for movement to a first position wherein the removable section is coupled to the patient support, a second position wherein the removable section is adjacent to but spaced from the first position and a third position spaced apart from the patient support. A sensing mechanism is configured for sensing a presence of the removable section at and between the first and second positions thereof. A latch recess mechanism is mounted on the patient support and configured to be engaged by the sensing mechanism in response to the removable section being moved from the third position toward the first position, the latch recess mechanism including at least one recess. A latch mechanism is mounted on the removable section and includes a latch member configured to move into the at least one recess only in response to the sensing mechanism sensing the presence of the removable section at the first position.

BRIEF DESCRIPTION OF THE DRAWINGS

The purposes of the invention will be apparent to persons acquainted with apparatus of this general type upon reading the following specification and inspecting the accompanying drawings, in which.

DETAILED DESCRIPTION OF THE PREFERRED EMBODIMENT

Figures 1, 2:
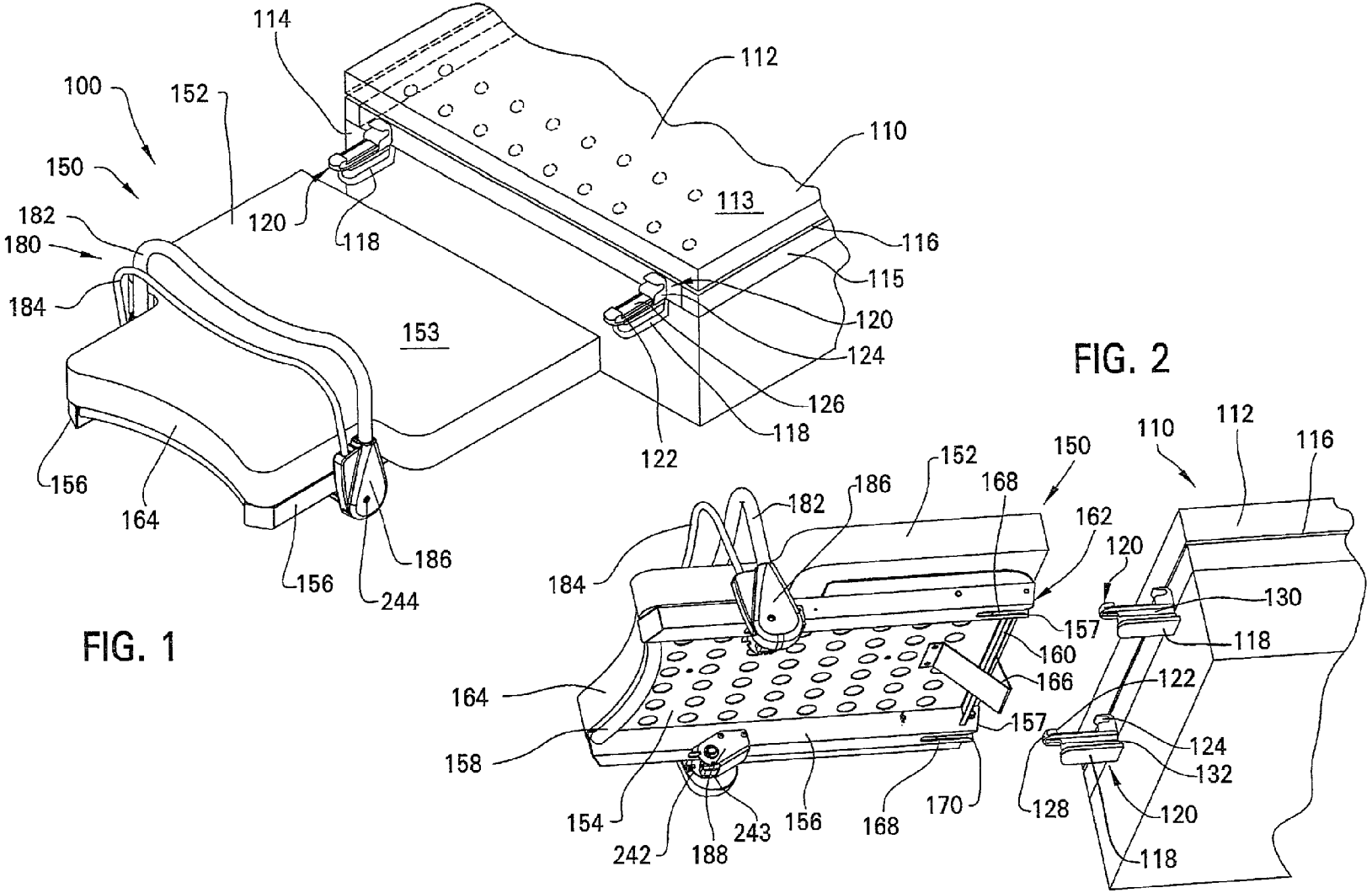
FIG. 1 is a perspective view of a patient support apparatus with a removable foot section according to the invention.
FIG. 2 is a bottom perspective view of the patient support apparatus of FIG. 1.

Certain terminology will be used in the following description for convenience in reference only and will not be limiting. The words "up", "down", "right" and left" will designate directions in the drawings to which reference is made. The words "in" and "out" will refer to directions toward and away from, respectively, the geometric center of the device and designated parts thereof. The words "proximal" and "distal"

will refer to the orientation of an element with respect to the patient support apparatus. Such terminology will include derivatives and words of similar import.

Referring to FIG. 1, a patient support apparatus 100 with a removable foot section is illustrated. The patient support apparatus 100 includes a main bed 110 to which removable foot section 150 is removably mounted, as will be more fully described below.

The main bed 110 includes a support base 115 to which is mounted a main bed patient support deck 116. The support deck 116 supports a main bed pad or mattress 112 having an upper surface 113. The main bed 110 further includes an anterior or perineal edge face 114 adapted for receiving the removable foot section 150.

A pair of mounting brackets 118 (FIGS. 1-3) is positioned distally from the anterior face 114 and is configured for mounting a pair of latch mounts 120 for securing the removable foot section 150 proximate the anterior face 114 of main bed 110. The mounting brackets 118 can be configured as disclosed in commonly owned U.S. Pat. No. 7,127,756, which is hereby incorporated herein by reference. The removable foot section 150 can be supported by a pair of abductors as illustrated therein, for alignment of the removable foot section 150 with the latch mounts 120. In the alternative, the removable foot section 150 and the abductors can be arranged to deliberately preclude support of the removable foot section 150 by the abductors, in order to force an operator to deliberately align the removable foot section 150 with the latch mounts 120, and to avoid inadvertent placement of the removable foot section 150 adjacent the main bed 110 in a non-engaged condition.

Each latch mount 120 has a generally upwardly opening "C" shape and includes a distal or nose portion 128 incorporating an upwardly and inwardly directed catch 122, a flattened central portion 126 and a raised proximal portion including an inwardly directed recess 124. Referring further to FIG. 2, each latch mount 120 includes a mounting base 132 for mounting the latch mount 120 to the mounting bracket 118. Each latch mount 120 further incorporates a pair of parallel opposing side channels 130 forming a narrowed center section or neck 129 for facilitating insertion of the latch mount 120 into the removable foot section 150 as will be further described below.

Referring to FIGS. 1 and 2, the removable foot section 150 includes a proximal end 162 and a concave distal end 164. The removable foot section 150 further includes a pair of tubular side rails 156, a proximal cross rail 160 and an arcuate distal cross rail 158. The tubular side rails 156 each include a proximal end 157. A foot section patient support deck 154 is mounted to the rails 156, 158, 160. The patient support deck 154 is further configured for supporting a foot section pad 152 having an upper surface 153. When the removable foot section 150 is attached to the main bed 110, the upper surface 153 of the foot section 150 will be contiguous with the upper surface 113 of the main bed pad 112.

The removable foot section 150 further includes a brace 166 attached to and depending from the proximal cross rail 160 and the foot section patient support deck 154. The brace 166 is configured to support the removable foot section 150 in a vertical orientation on a floor surface when the foot section 150 is removed from the main bed 110. The removable foot section 150 is configured to stand, in the vertical orientation, on the brace 166 and the proximal end 157 of the side rails 156.

At the proximal ends 157 of the side rails 156, each side rail 156 includes a mount-receiving slot 168 with a chamfered mouth 170. A sleeve 224 is secured within the side rail 156 over the mount-receiving slot 168 by a fastener 225. The mount-receiving slots 168 are adapted for receiving the latch mounts 120 in such a manner that the neck 129 of each latch mount 120, formed by the side channels 130, aligns with the respective mount-receiving slot 168 of the side rails 156. The sleeve 224 is positioned within the side rail 156 for alignment with the recess 124 of the latch mount 120 as the latch mount 120 enters the side rail 156. The chamfered mouth 170 of each mount-receiving slot 168 aids the operator in guiding the latch mounts 120 into the mount-receiving slots 168.

The removable foot section 150 further includes a locking mechanism 180 for releasably locking the removable foot section 150 to the main bed 110. As seen in FIGS. 1-2, the locking mechanism 180 presents an operator with a main U-shaped handle 182 and a U-shaped release lever 184 pivotally associated with the main U-shaped handle 182. The handle 182 and release lever 184 are inverted "U"s straddling the removable foot section 150 in the form of an arch. Each depending leg of the handle 182 and release lever 184 terminate within a handle pivot assembly 186. The handle pivot assembly 186 is pivotally mounted to a locking mechanism cam housing 188 depending from each side rail 156. Each cam housing 188 is U-shaped, with each upstanding leg or wall of the cam housing 188 connecting to the tubular side rail 156 so that the cam housing 188 hangs directly beneath the side rail 156.

Figure 3:
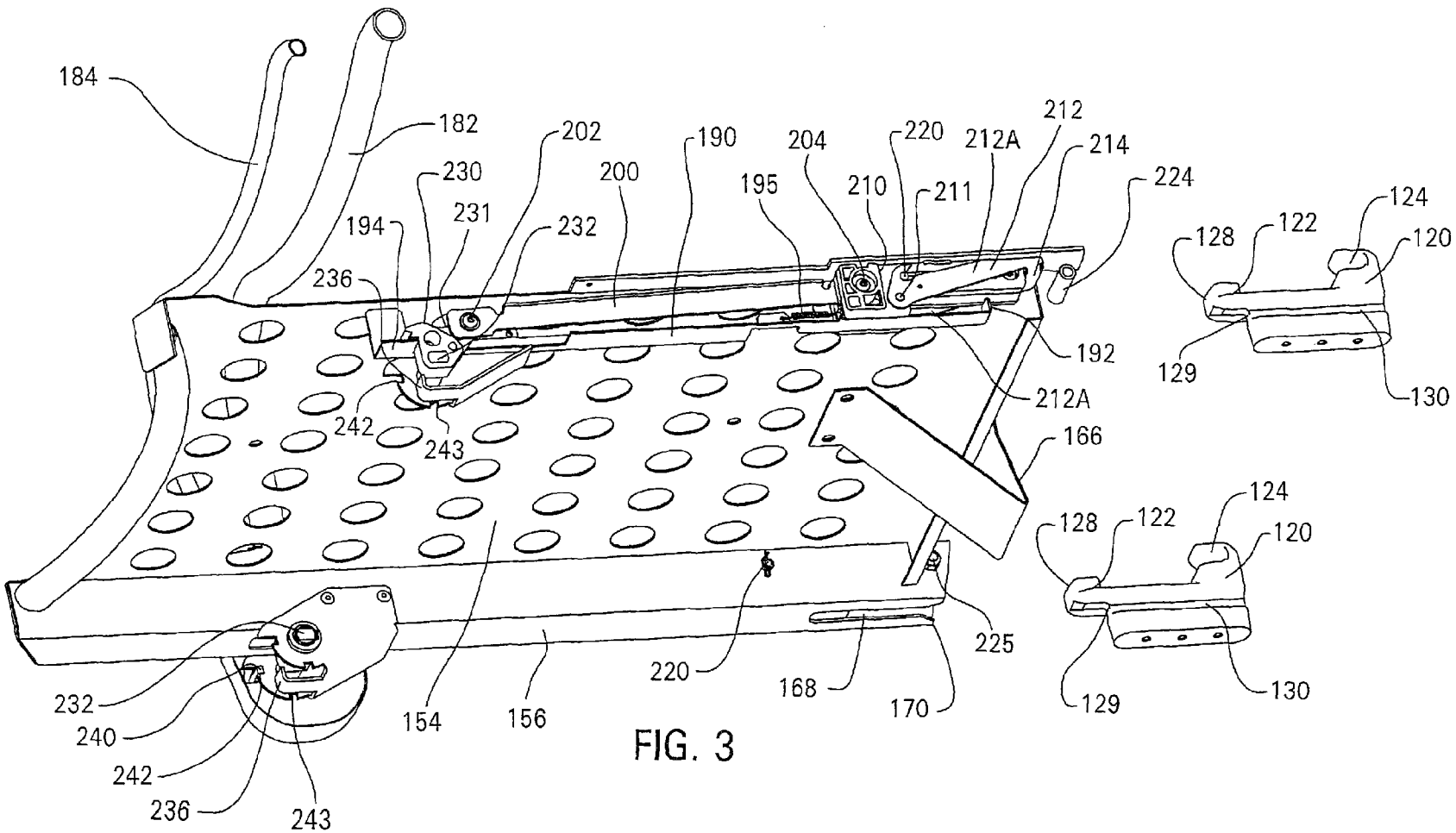
FIG. 3 is a partial cut-away view of the patient support apparatus of FIG. 2.
Figure 4:
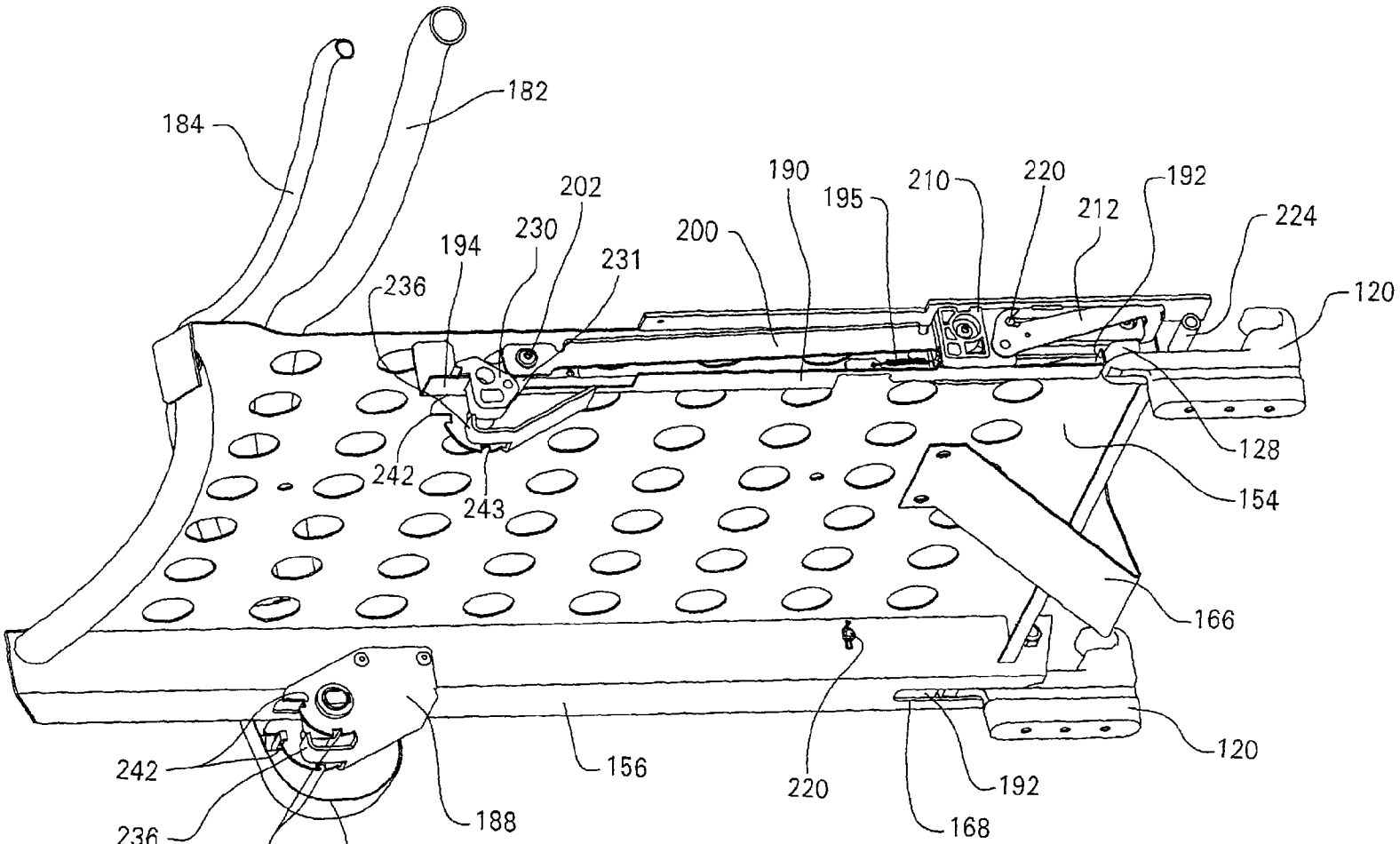
FIG. 4 is a partial cut-away view of the removable foot section moving toward an attached position on the patient support apparatus.
Figure 5:
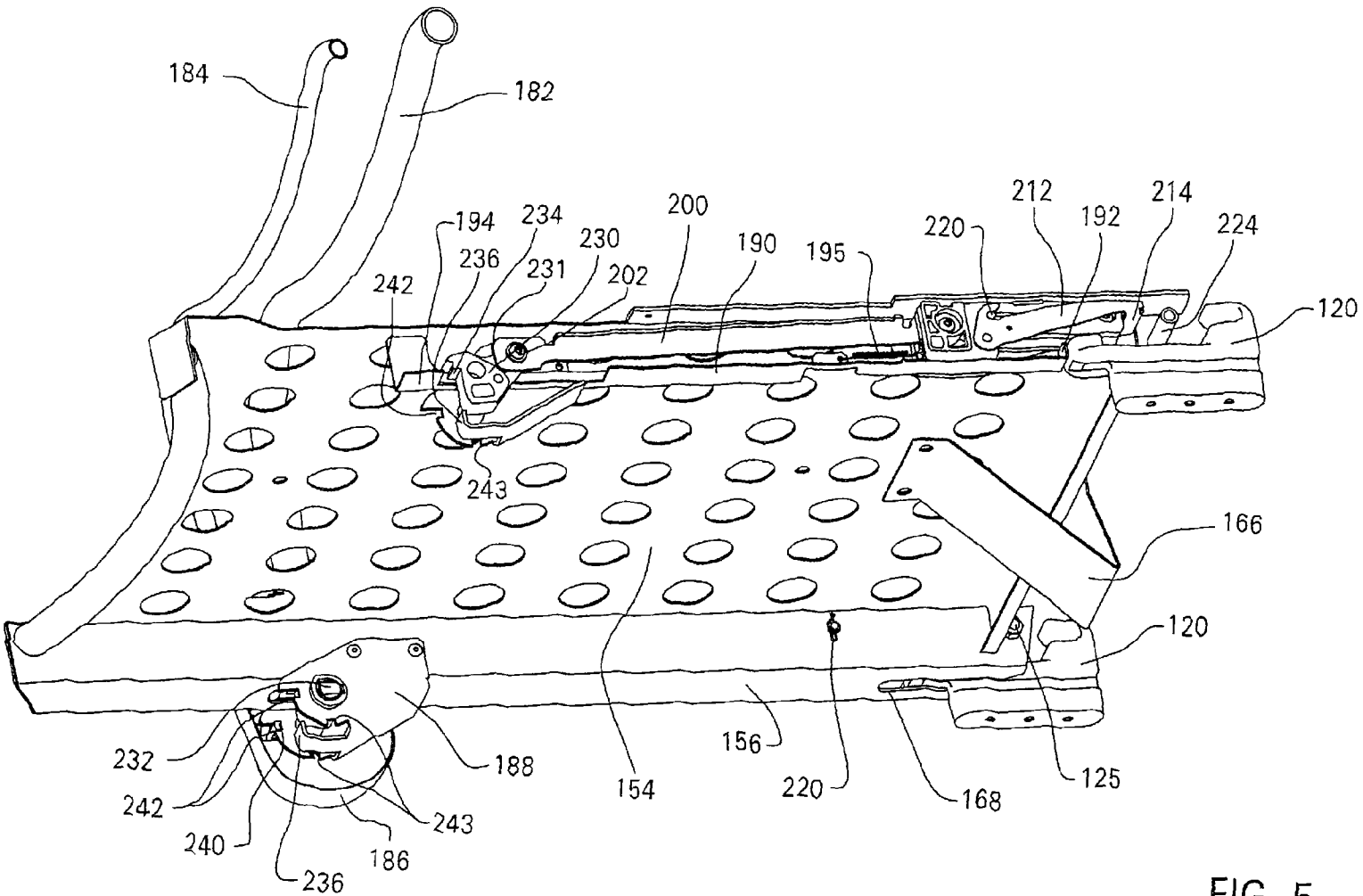
FIG. 5 is a partial cut-away view of the removable foot section of FIGS. 1-4 with a sensing link activated by a patient support apparatus latch mount.
Figures 6A, 6B:
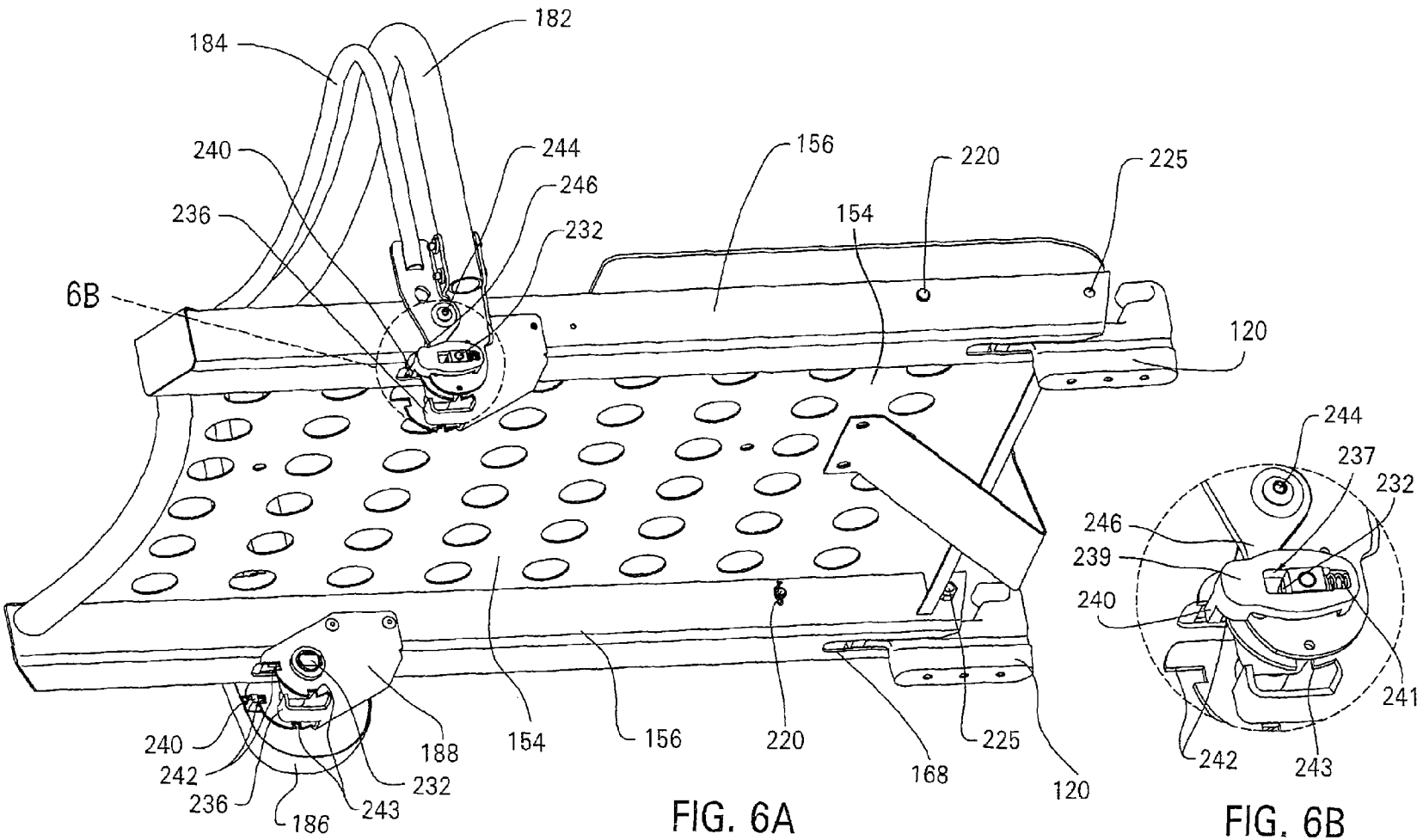
FIG. 6A is a bottom perspective view of the removable foot section of FIGS. 1-5 with a secondary locking mechanism disengaged.
FIG. 6B is an enlarged view of a handle pivot mechanism according to FIG. 6A.
Figure 7:
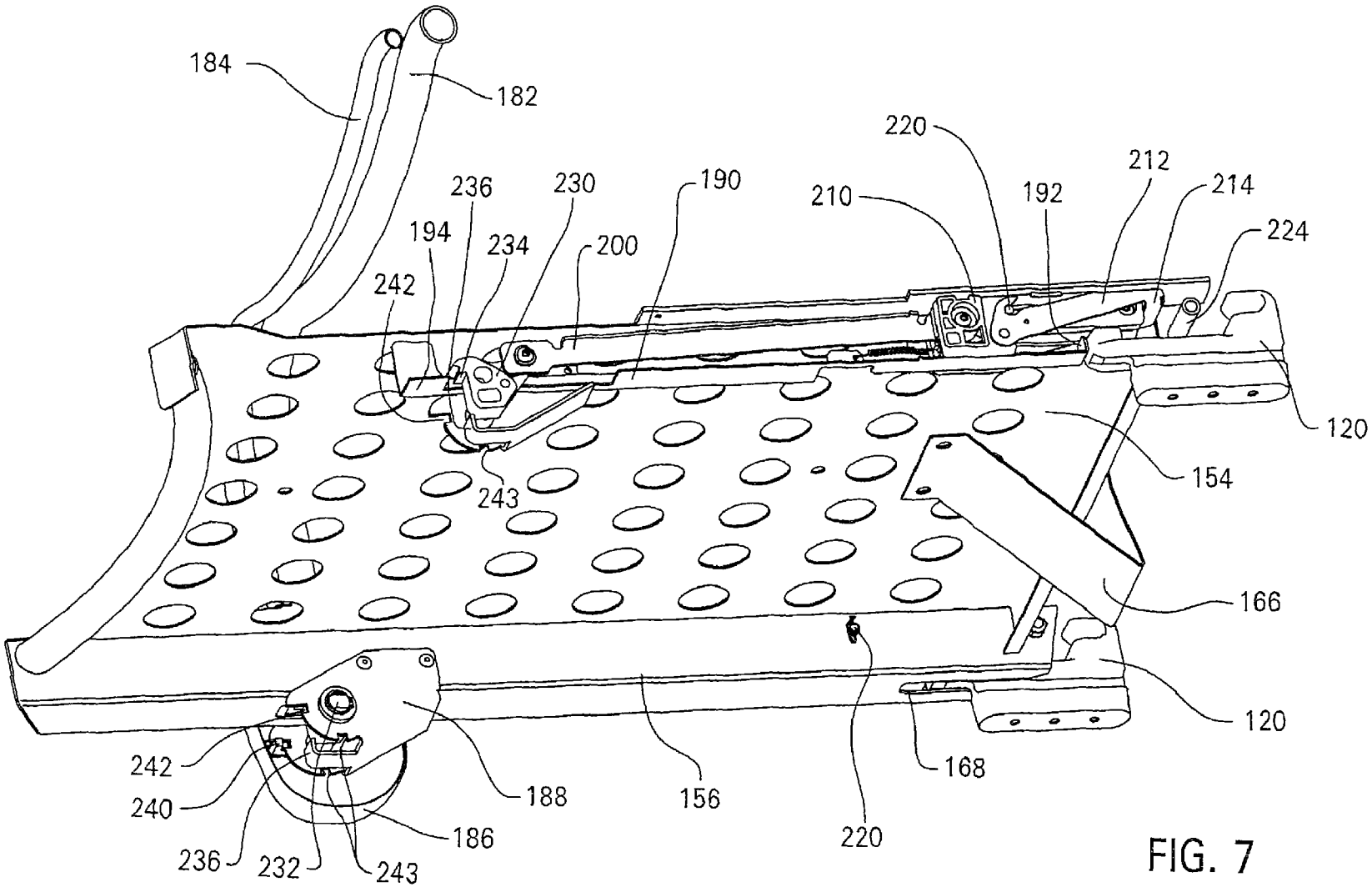
FIG. 7 is a partial cut-away perspective view of the removable foot section of FIG. 6.

Referring briefly to FIGS. 6A-6B, the cover of the handle pivot assembly 186 has been removed to reveal that the release lever 184 is pivotally attached to the main handle 182 by a pivot pin 244, and includes a distal portion 246 extending beyond the fulcrum formed by the pivot pin 244. The main handle 182 is fixedly mounted to a double-D-shaped cam pin 232 which rotatably mounts the main handle 182 to the cam housing 188. A spring-urged plate 239 having a central elongate slot 237 is slidably mounted on the cam pin 232. The plate 239 includes a locking lug 240 extending inwardly toward the cam housing 188, and adapted, under the urging of a spring 241, for engaging one of a number of notches 242, 243 formed in the wall of cam housing 188. In FIGS. 6A-6B, the release lever 184 has been rotated about the pivot pin 244 so that the distal portion 246 of the release lever 184 has countered the urging of the spring 241 on the plate 239, forcing the locking lug 240 out of the notch 242. In FIGS. 3-4, the locking lug 240 is urged by the spring 241 into the notch 242.

Referring now to FIG. 3, a partial cut-away view of the removable foot section 150, the internal components of the locking mechanism 180 within one side rail 156 are illustrated. The handle pivot assembly 186, the outer wall of the cam housing 188 and the side rail 156 have been removed to reveal the internal components. The configuration of the locking mechanism 180 of each side rail 156 is the same. In the following description, the components and function of only one side rail 156 will be described, but it is to be understood that the components and function apply to both side rails 156. It is to be recognized that some portions of the handle pivot assembly 186 will need to be a mirror image of the other for attachment to the outside of the respective side rail 156.

The locking mechanism 180 within the tubular side rail 156 includes a locking cam 230, a carriage assembly 210 connected to the locking cam 230 by an elongate locking mechanism linkage 200, and an elongate sensing link 190.

The locking cam 230 is eccentrically mounted on the double-D-shaped cam pin 232 and is rotatably connected to the cam housing 188. The locking cam 230 includes a lever arm 231 and a distally extending flat portion 234.

The locking mechanism linkage 200 is pivotally connected at its distal end to the lever arm 231 of the locking cam 230 by a pivot pin 202, and is pivotally connected at its proximal end to the carriage assembly 210 by a pivot pin 204.

The carriage 210 is slidably received within the tubular side rail 156. The carriage 210 carries a U-shaped pivotal locking arm 212, the bight portion of the "U" forming a locking hook 214. The legs 212A (see FIG. 3) of the "U" straddle the carriage 210 and are pivotally supported on the carriage 210 by a pivot pin 211. The locking hook 214 is forced upward as a locking pin 220, fixed to the respective side rail 156, pivots the locking arm 212 about the pivot pin 211 by pressing against a distal portion of the locking arm 212.

The elongate sensing link 190 is slidably carried within the tubular side rail 156 and includes a proximal end 192 and a distal end 194. The sensing link 190 is spring-biased in a proximal direction by a spring 195 connecting the sensing link 190 to the carriage assembly 210, forcing the proximal end 192 of the sensing link 190 toward the proximal end 157 of the side rail 156. As shown in FIGS. 3-4, the distal end 194 of sensing link 190 is urged by the bias of the spring 195 against the locking cam 230 and under the flat portion 234.

Operation

As shown in FIGS. 1-5, the main handle 182 is shown locked in an upright "carry" position. The arcuate distal end of the removable foot section 150 can be balanced against the operator's midsection while the operator carries the removable foot section 150 by the upright, locked main handle 182. It will be intuitive to the operator that the carry handle must be moved from the upright "carry" position to a stowed position so as to not interfere with the use of the patient support apparatus.

Referring to FIGS. 1-4, the main handle 182 is prevented from rotating from its upright "carry" position by two mechanisms, the locking cam 230 and the spring-urged plate 239 (see FIGS. 6A and 6B). The handle 182, the locking cam 230, and the plate 239 are all rotatably fixed on the double-D-shaped cam pin 232. The locking cam 230 is prevented from rotating due to the positioning of the distal end 194 of the sensing link 190 under the flat portion 234 (FIG. 5) of the locking cam 230. The plate 239 is urged by the spring 241 so that locking lug 240 is received in the notch 242. In order to rotate the handle 182, both of these locking mechanisms must be released.

To releasably attach the removable foot section 150 to the main bed 110, the removable foot section 150 must begin at a position removed from the anterior face 114, with the upper surface 153 of the foot section pad 152 substantially co-planar with the upper surface 113 of the main bed pad 112. This will align the bottom face of the side rails 156 and therefore the mount receiving slots 168 with the side channels 130 of the latch mounts 120. The side rails 156 must also be aligned laterally with the latch mounts 120.

As the removable foot section 150 is moved toward the main bed 110, the nose end 128 of each latch mount 120 will enter a respective side rail 156 such that the side channels 130 will be received in the mount receiving slots 168. Since the nose section 128 of the latch mount 120 is lower than the raised proximal portion of each latch mount 120, the nose section 128 will clear the sleeve 224 mounted within each side rail 156 (see FIG. 4). As each latch mount 120 enters each side rail 156, the nose section 128 will contact the proximal end 192 of each sensing link 190.

Further movement of the foot section 150 toward the main bed 110 will cause the nose section 128 to force the sensing link 190 against the bias of the spring 195. As the sensing link 190 is displaced against the bias of spring 195, the distal portion 194 of the sensing link 190 is forced clear of the flat portion 234 of the cam 230. With the distal portion 194 of the sensing link 190 displaced, as shown in FIGS. 5-9, the flat 234 can now clear the distal portion 194 of sensing link 190 so that the cam 230 can rotate in a counter clockwise direction.

Before the handle 182 can be rotated, however, the secondary locking mechanism comprising the lug 240 within the notch 242 must be disengaged. In a natural and intuitive operation, aided by color-coding or instructional wording on the release lever 184, the operator will squeeze together the release lever 184 and the main handle 182. The release lever 184 is thereby rotated about the pivot pins 244, causing the distal portion 246 of the release lever 184 to shift the plate 239 against the urging of spring 241 and extract the locking lug 240 from the notch 242 (see FIGS. 6A-6B). With the locking lug 240 out of the notch 242, the double-D-shaped cam pin 232, the locking cam 230, the plate 239, and the main handle 182 are free to rotate together relative to the cam housing 188. With the removable foot section 150 still supported in the engaged position against the main bed by the operator's midsection, the operator can then draw the main handle 182 distally about the cam pin 232, thereby engaging the locking mechanism 180 for securing the removable foot section 150 to the main bed 110.

Figure 8:
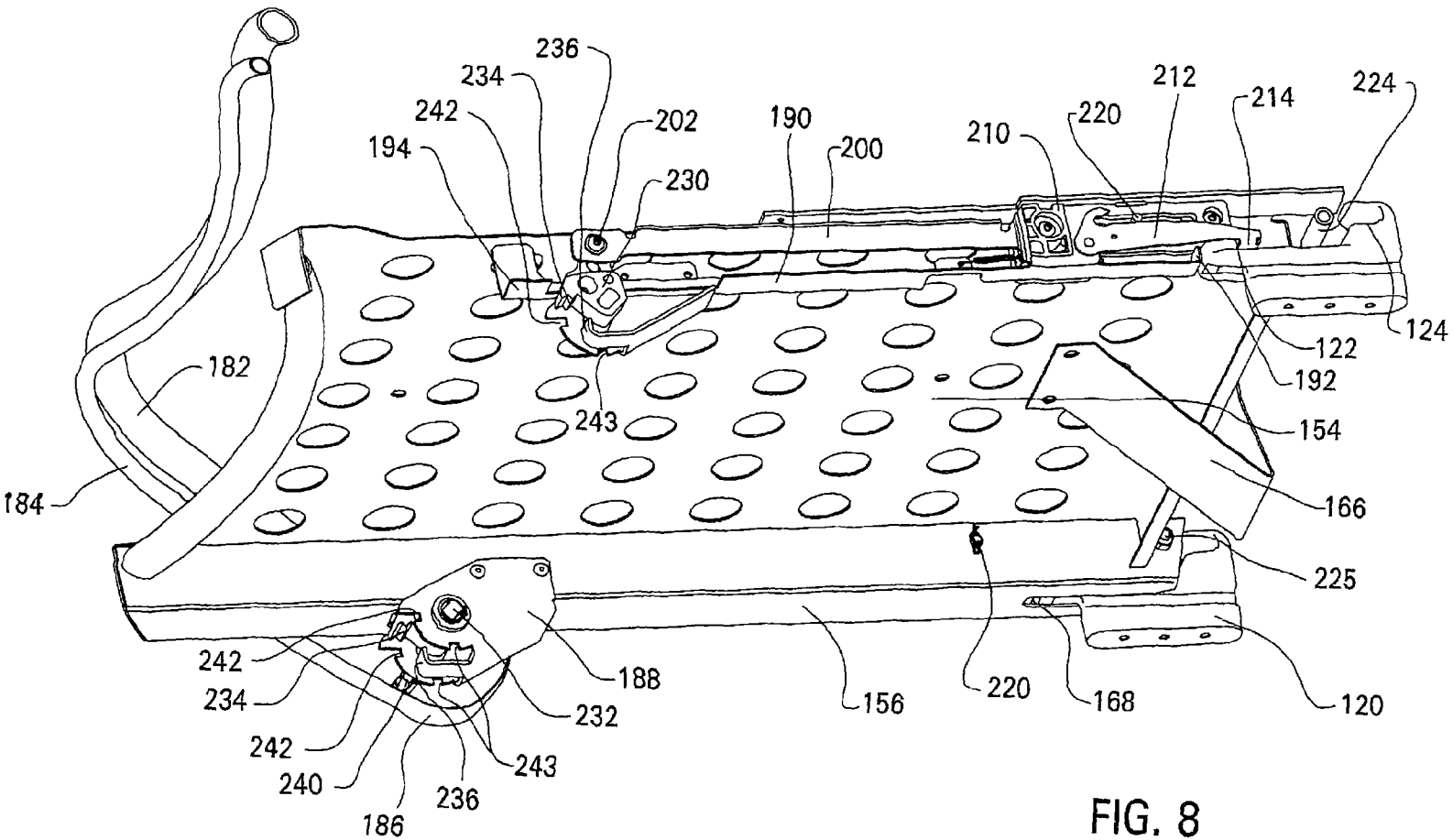
FIG. 8 is a partial cut-away view of the removable foot section of FIGS. 1-7 with the locking mechanism partially engaged.
Figure 9:
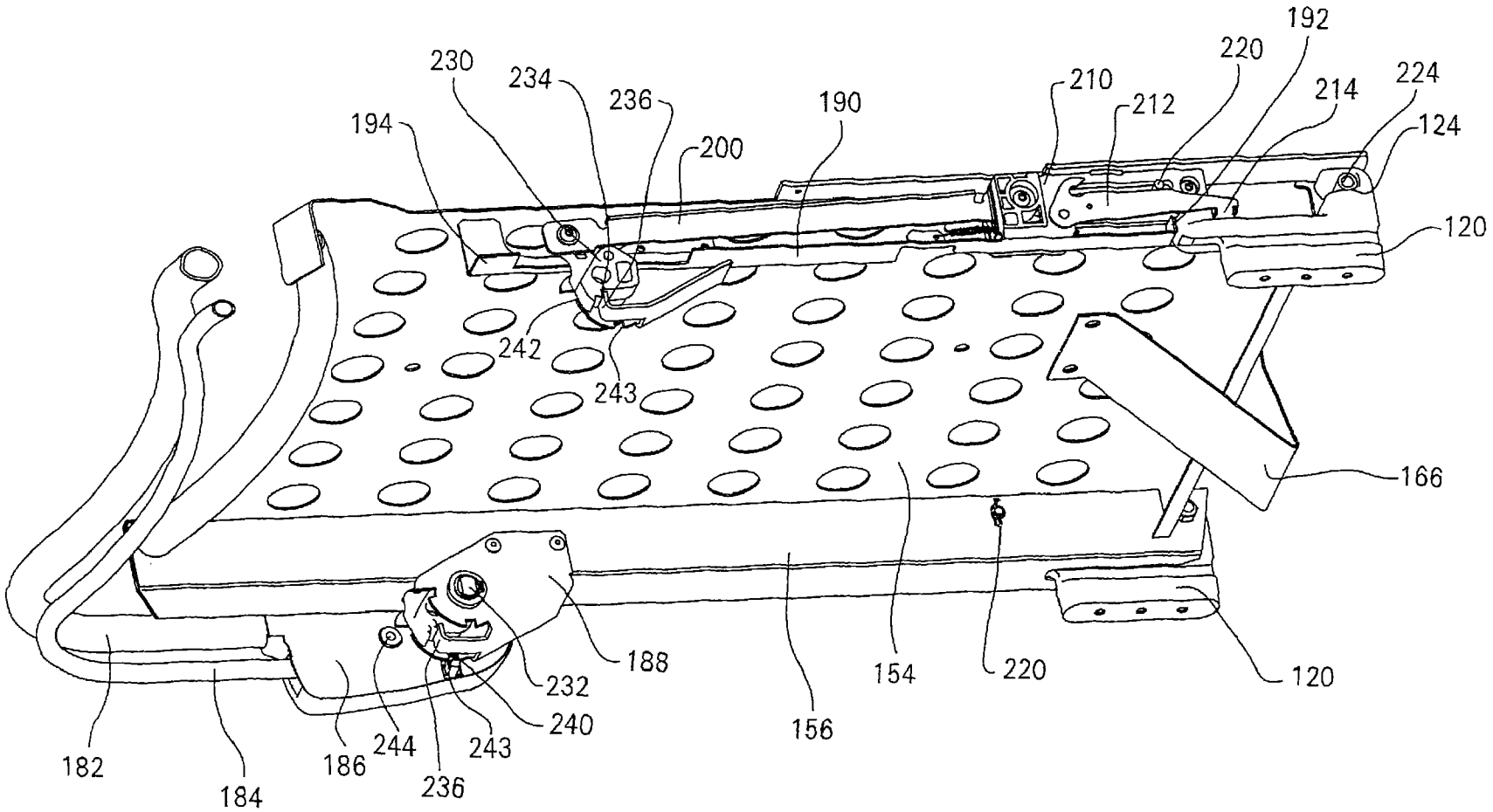
FIG. 9 is a partial cut-away perspective view of the removable foot section of FIGS. 1-8 with the locking mechanism fully engaged.

With particular reference to FIG. 8, as the cam pin 232 rotates with the main handle 182, the lever arm 231 of the cam 230 draws the locking mechanism linkage 200 toward the distal end of removable foot section 150, drawing the carriage assembly 210 with it. As the carriage assembly 210 traverses distally with respect to the locking pin 220, the locking hook 214 is urged by sliding contact with the locking pin 220 into the central portion 126 of the latch mount 120 and then is drawn distally against the catch 122. Further rotation of the cam 230 will result in the foot section 150 being drawn in toward the anterior face 114 of the main bed until the sleeve 224 is received in the recess 124 of the latch mount 120.

The cam housing 188 includes a stop 236 positioned such that the flat portion 234 of the cam 230 reaches the stop 236 as the sleeve 224 is fully received in the recess 124 of the latch mount 120. This coincides with the main handle 182 having rotated approximately 90 degrees so that it is substantially co-planar with the side rails 156, and no longer interferes with the use of the bed. Upon release of the main handle 182 and the release lever 184 by the operator, the spring 241 acting on the plate 239 will urge the locking lug 240 inwardly to engage the notch 243 in the cam housing 188. The notch 243 is positioned on the cam housing 188 to correspond to the main handle 182 being in the horizontal position.

The removable foot section 150 is thereby positively mounted to the main bed 110 until an operator proactively grasps the main handle 182 and the release lever 184 and moves the release lever 184 toward the main handle 182, thence causing the locking lug 240 to be extracted from the notch 243. The operator then rotates the main handle 182 in a clockwise rotation, reversing the above-described sequence to disengage the locking mechanism 180. When main handle 182 reaches the upright position and the release lever 184 is released by the operator, the locking lugs 240 will enter the notches 242 under the urging of the springs 241 to lock the handle 182 in the upright position. The removable foot section 150 can thereafter be lifted away from the main bed 110. The concave distal end 164 of the removable foot section 150 is configured for resting against the operator's midsection while the operator lifts the removable foot section 150 by the main handle 182. With the concave distal end 164 resting against the operator's midsection, the center of mass of the removable foot section 150 is advantageously drawn closer to the operator, rendering the removable foot section 150 easier to lift and transport.

Second Embodiment of FIGS. 10-16

Referring now to FIGS. 10-16, a further embodiment of a locking mechanism 300 for a removable foot section for a patient support apparatus is illustrated. The mechanism 300 includes a plate-like latch mount 310 configured for mounting to a main bed comparable to the main bed 110 described above. The latch mount 310 includes a sensing link receiver 312, a latch receiver/recess 314 and a catch 316.

Figure 10:
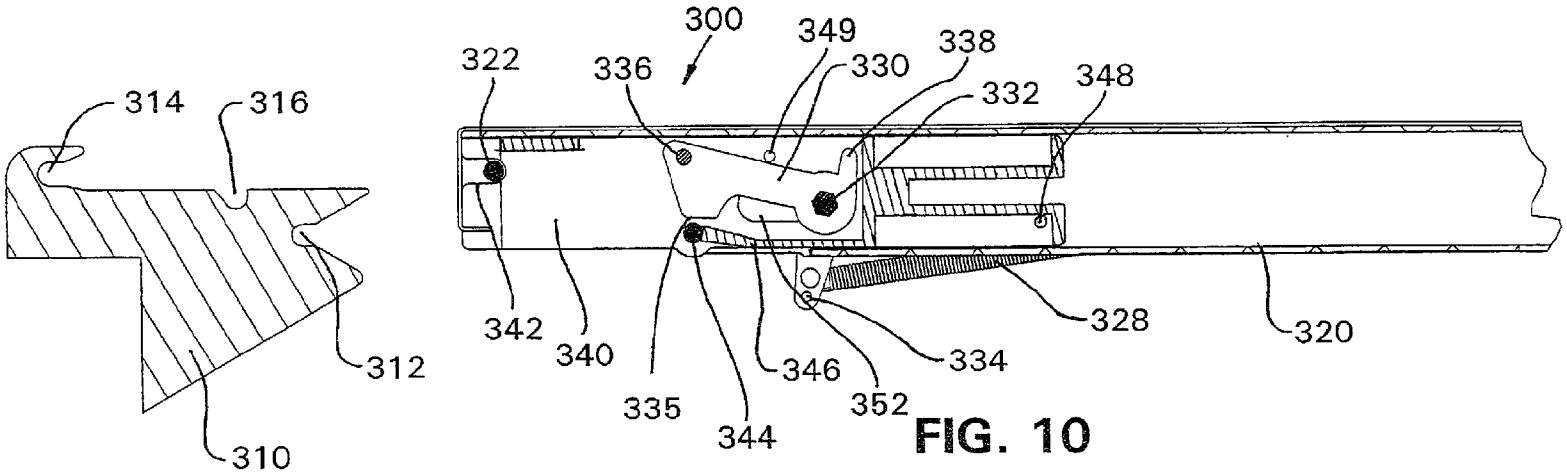
FIG. 10 is a cross-sectional view of a locking mechanism according to a second embodiment of the invention.
Figure 11:
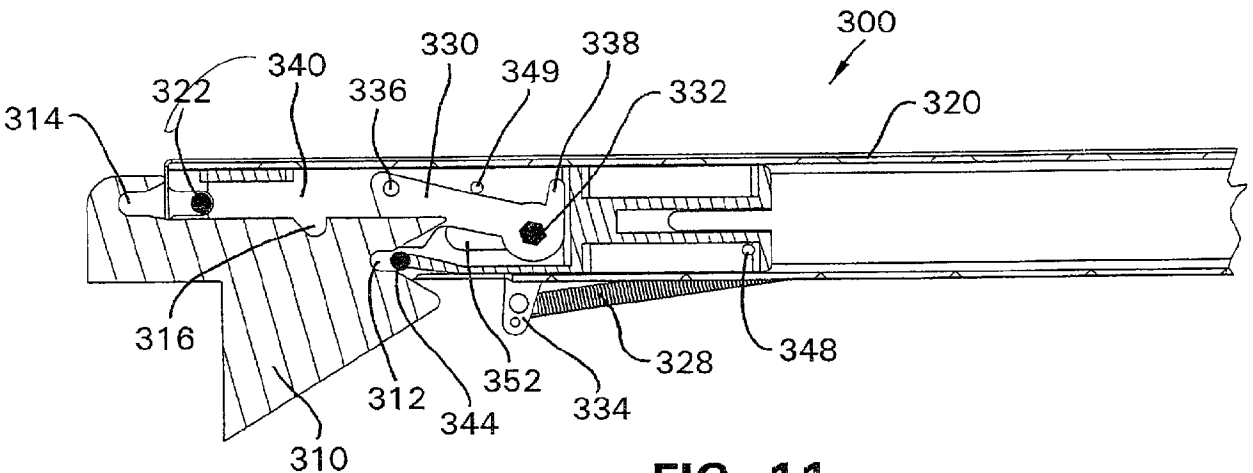
FIGS. 11-16 are cross-sectional views of the locking mechanism of FIG. 10 sequentially illustrating the locking action of the mechanism.

The removable foot section includes a rail 320 that is substantially rectangular in cross-section. A cross pin 322 is fixedly mounted near the proximal end of the rail 320. A locking arm 330 is pivotally mounted to the rail 320 by a spring/locking arm pivot 332. The locking arm 330 is pivotally linked to a spring arm 334 also pivoting about the spring/locking arm pivot 332 and biased in a counter clockwise direction (as shown in FIG. 10) by a spring 328.

The locking arm 330 includes a locking arm face 335 and is prevented from rotating through the contact of the locking arm face 335 with a sensing link nose 344. The sensing link nose 344 is part of a sensing link 340 slidably mounted within the rail 320. The sensing link 340 includes a longitudinal slot 352 for facilitating a relative movement to the spring/locking arm pivot 332 of the locking arm 330. The sensing link 340 further incorporates a proximal slot/recess 342 for clearing the cross pin 322 of the cross rail 320.

Referring sequentially to FIGS. 10-15, as the foot section is moved or pushed by the attendant proximally toward the main bed, the latch mount 310 enters the proximal end of rail 320 through appropriately provided slots as in the embodiment described above. The first positive engagement occurs between the sensing link receiver 312 of the latch mount 310 and the sensing link nose 344 of the sensing link 340.

Figure 12:
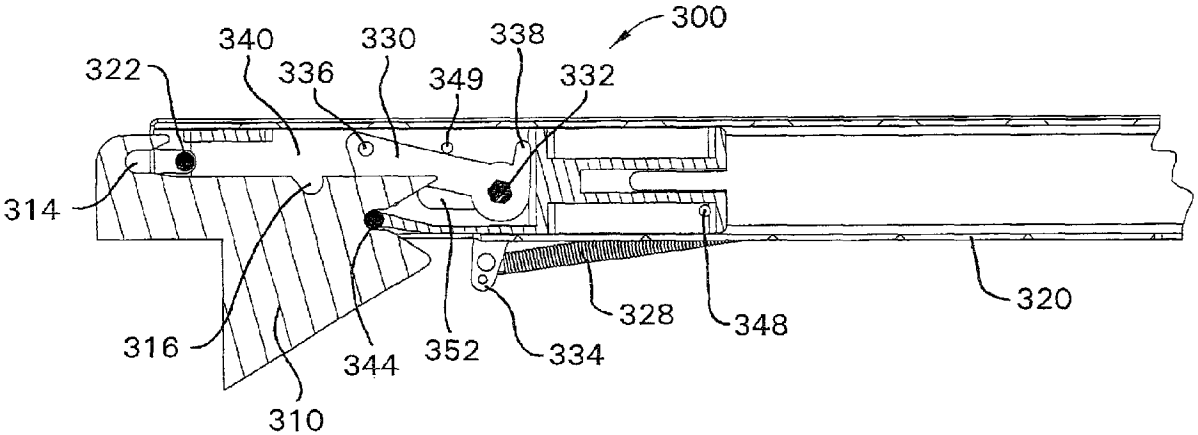
Figure 13:
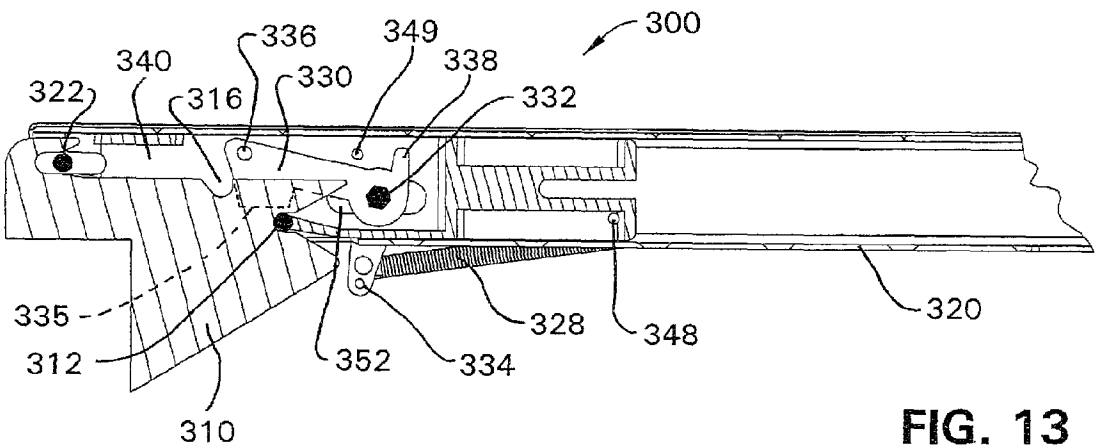
Figure 14:
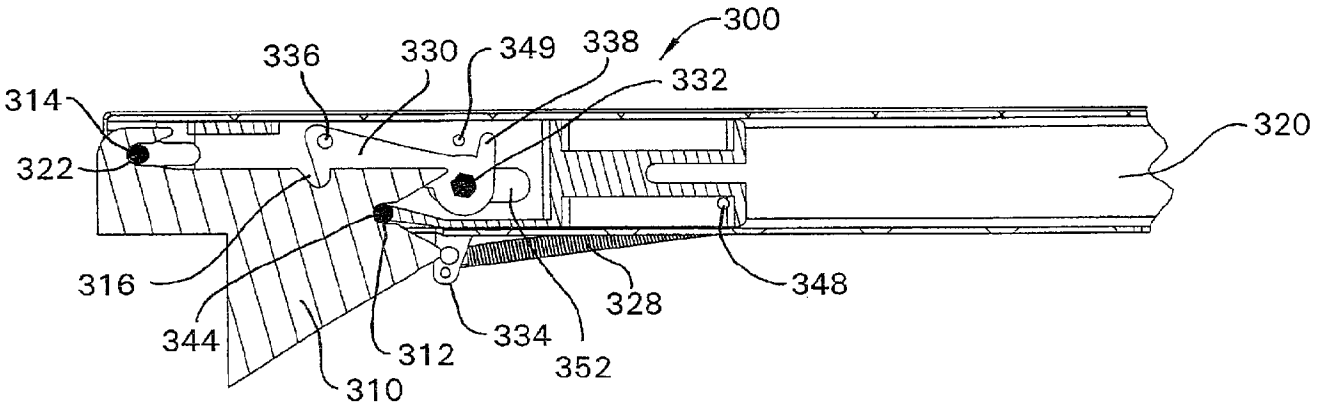
Figure 15:
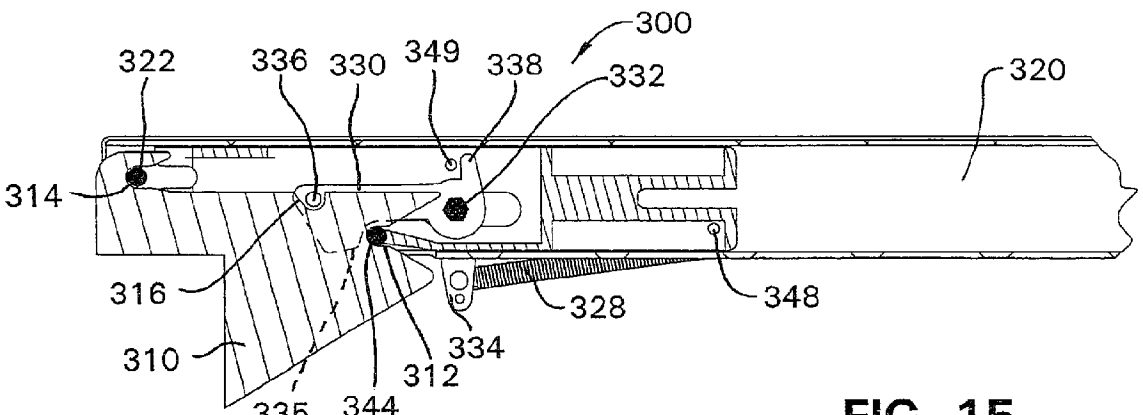

As the sensing link nose 344 contacts and is displaced distally by the latch mount 310 as shown in FIGS. 12-13, the sensing link 340 is displaced distally with respect to the rail 320 as the rail 320 continues its movement toward engagement with the latch mount 310. As the cross pin 322 becomes fully engaged with the latch receiver/recess 314 of the latch mount 310, the sensing link nose 344 is pushed by the latch mount 310 past the locking arm face 335 of the locking arm 330. When the sensing link nose 344 has cleared the locking arm face 335, the locking arm 330 is biased counter clockwise by the spring 328, forcing the locking hook 336 mounted to the locking arm 330 into the catch 316 of the latch mount 310. The foot section is thereby locked with the main bed in a positive manner.

Figure 16:
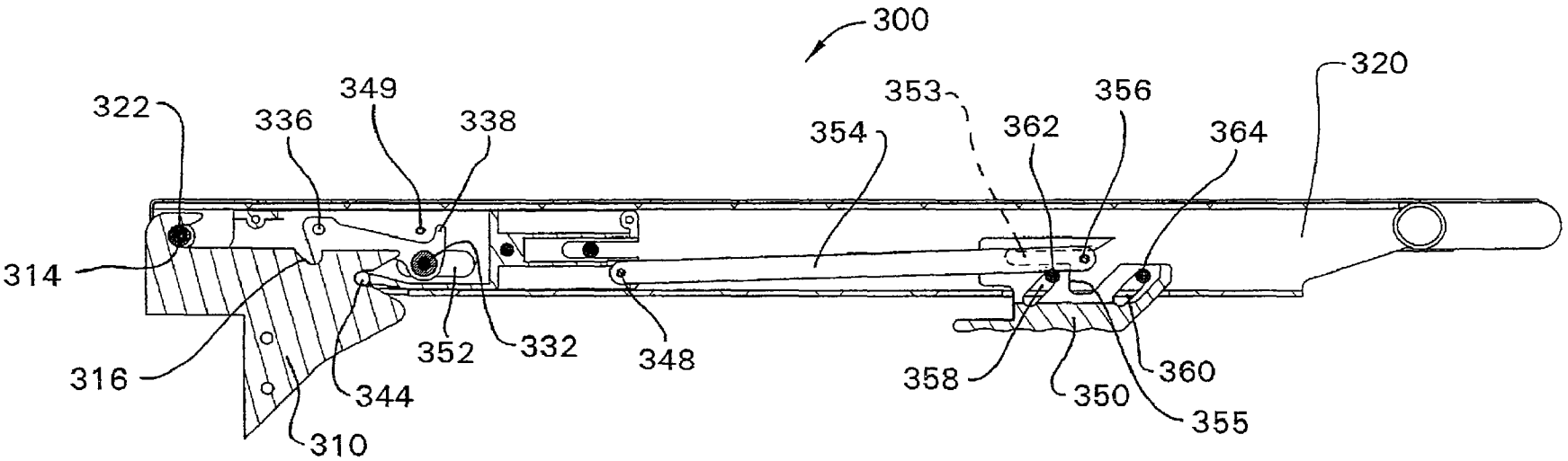
Figure 17:
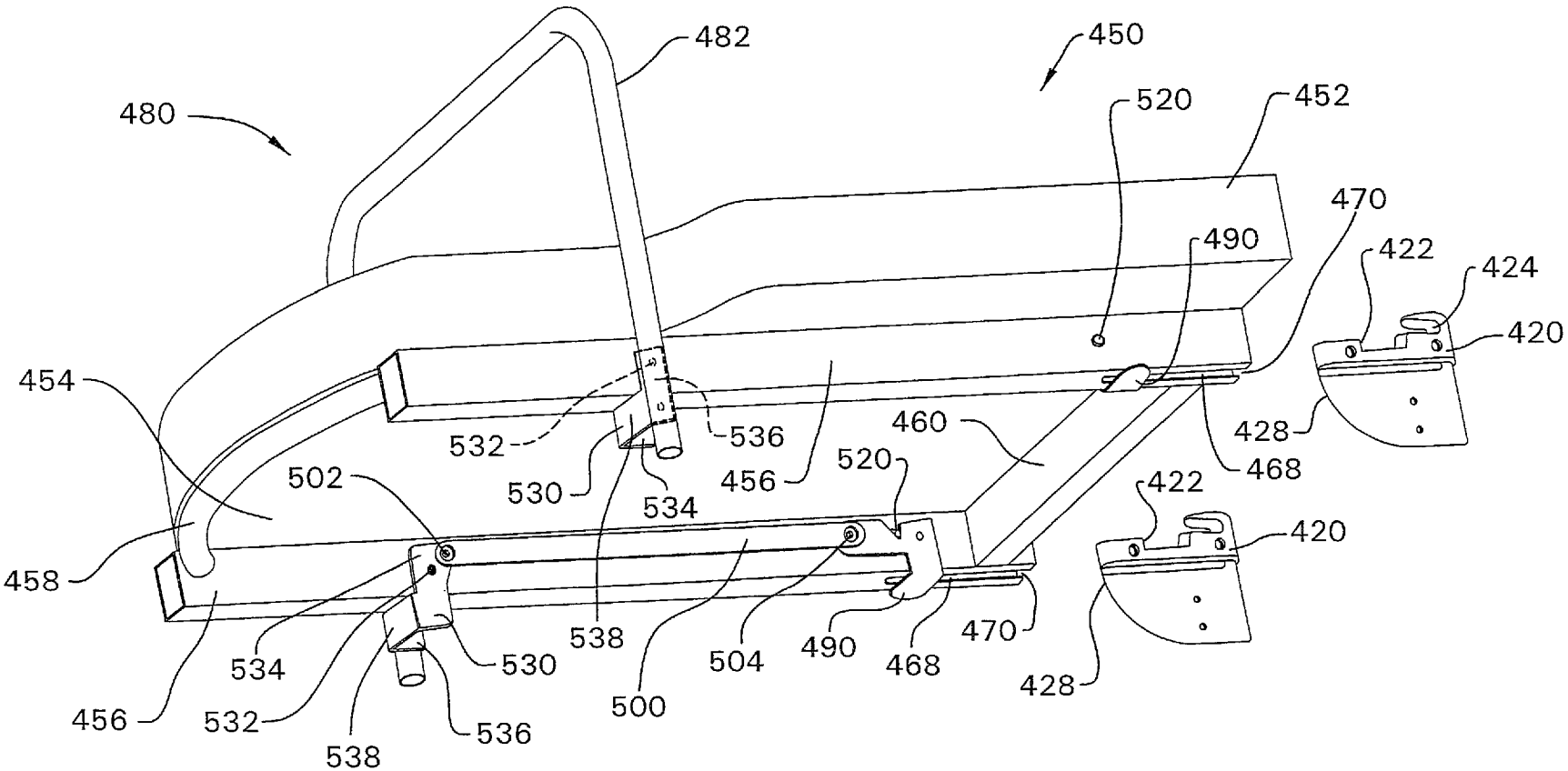
FIG. 17 is a bottom perspective view of a removable foot section according to a further embodiment of the invention.

Referring to FIG. 16, a release mechanism is disclosed whereby a release handle 350 is slidably mounted to the side rail 320. The release handle 350 includes two angled slots 358, 360 configured to ride on laterally extending pins 362, 364 secured to the frame 320, so that as the release handle 350 is depressed (or lifted), the angled slots 358, 360 will cause the release handle 350 to be drawn upward and to the right. A link aim 354 is pivotally mounted to the sensing link 340 by a pivot pin 348. The link arm 354 includes a second pin 356 configured to engage the release handle 350, and is supported by the laterally extending pin 362. When the sensing link 340 is in the non-engaged position, i.e. fully extended to the left, the link arm 354 is also drawn to the left. With the link arm 354 drawn to the left, the second pin 356 is drawn into a longitudinal slot 353 formed in the release handle 350. Therefore, if the release handle is depressed when the sensing link 340 is not engaged by the latch mount 310, the second pin 356 can slide freely in the slot 353 and the sensing link 340 is not affected. With the sensing link 340 displaced to the right by engagement with the latch mount 310, the link arm 354 is also displaced to the right, as shown in FIG. 16. This shifts the second pin 356 out of the slot 353 and into a position to be engaged by a recess wall 355 formed on the release handle 350. As the release handle 350 is depressed, the second pin is engaged by the recess wall 355, causing sensing link 340 to be further displaced to the right. As sensing link 340 is displaced distally, a locking arm retracting pin 349 mounted on the sensing link 340 will bear against a locking arm retractor 338, acting against the bias of the spring 328 and causing the locking arm 330 to rotate clockwise as shown in FIG. 16. With locking hook 336 withdrawn from the catch 316, the foot section can be withdrawn distally from the main bed. As the foot section is withdrawn, the handle 350 can be released so that the sensing link nose 344 can engage the locking arm face 335 under the urging of the spring 328.

Third Embodiment of FIGS. 17-20

FIGS. 17-20 disclose a further embodiment of the patient support apparatus with a removable foot section 450 according to the invention. A pair of latch mounts 420 are provided, mounted to a main bed as described above in the first embodiment. The latch mounts 420 comprise an upwardly directed "C" shape, having an inwardly directed proximal recess 424 and an inwardly directed distal catch 422. The latch mounts 420 further include an arcuate nose portion 428.

The removable foot section 450 includes a foot section patient support deck 454 supported by a pair of longitudinal side rails 456 and cross rails 458, 460, and a pad 452 supported by the support deck 454. The side rails 456 each include a proximal slot 468 having a mouth 470 for receiving each of the latch mounts 420, as in the first embodiment.

The removable foot section 450 further includes an attachment and locking mechanism 480. The locking mechanism 480 includes a handle 482 in the form of an inverted "U". Each of the legs of the handle 482 are connected to a cam bracket 530. Each cam bracket 530 is pivotally mounted to one of the side rails 456 by a pivot pin 532. The cam bracket 530 includes an internal cam plate 534 pivotally connecting the cam bracket 530 to a connecting link 500 by a pivot pin 502, an external mounting plate 536 for mounting the handle 482 and a back plate 538 serving as a rotation stop of the cam bracket 530 with respect to the side rail 456. Each connecting link 500 is further pivotally connected to a carriage 510 and sensing link 490. The connecting link 500 is connected to the carriage 510 by a pin 504 passing through a slot (not shown) in the side rail 456. The slot enables proximal-distal movement of the pin 504 and the carriage 510 within the side rail 456. The sensing link 490 pivots about the pin 504.

Figure 18:
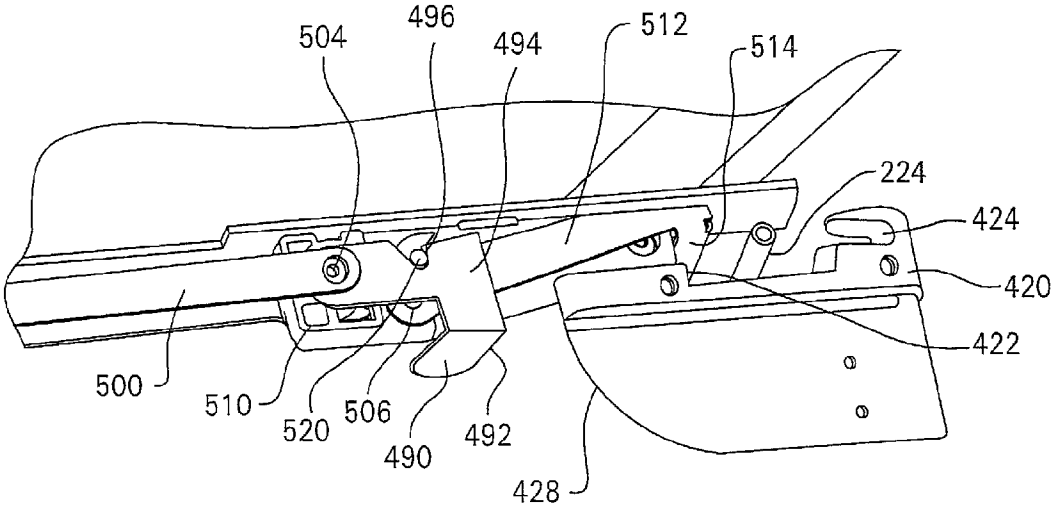
FIG. 18 is an enlarged cut-away view of a portion of the removable foot section of FIG. 17.
Figure 19:
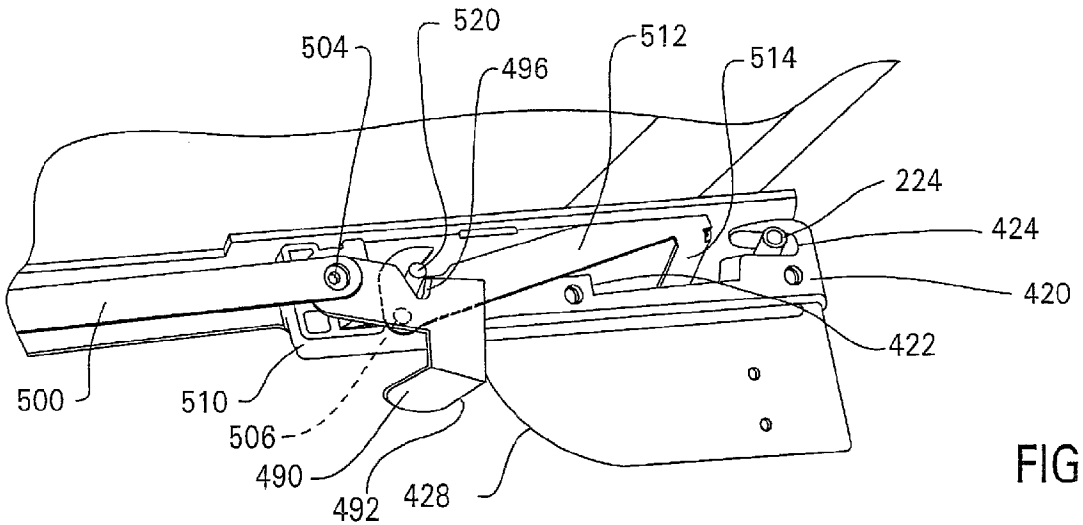
FIG. 19 is a partial cut-away view according to FIG. 18 with a latch mechanism partially engaged.

FIGS. 18 and 19 are enlarged cut-away views showing the carriage 510, the sensing link 490, and a locking arm 512, which can be of a U-shape straddling the carriage 510 with the bight portion forming a locking hook 514. The carriage 510 is slidably received in the side rail 456, and pivotally mounts the locking arm 512 about a pivot pin 506. The locking arm 512 is held in a raised position by a locking pin 520 after the same fashion as the first embodiment.

Referring specifically to FIG. 18, the sensing link 490 includes a catch 496 for receiving the locking pin 520. In the position shown in FIG. 18, the catch 496 has received the locking pin 520 therein, which prevents the carriage 510 from moving distally within the side rail 456. The handle 482 is also thereby prevented from rotating distally about pivot pin 532.

Referring to FIG. 19, the removable foot section 450 has been moved proximally toward the latch mount 420 so that the arcuate nose portion 428 of the latch mount 420 has engaged the leading edge 492 of the sensing link 490. This causes the sensing link 490 to pivot about the pin 504, disengaging the catch 496 from the pin 520. This frees the carriage 510 to slide distally, and therefore frees the cam bracket 530 to be rotated about pivot pin 532 and handle 482 to be rotated distally. Upon rotation of the cam bracket 530 about the pivot pin 532, the connecting link 500 is drawn distally, and the carriage 510 moves distally.

As the latch mount 420 is positioned to displace the sensing link 490, it further aligns the recess 424 with the sleeve 224, and aligns the locking hook 514 of the locking arm 512 with the catch 422 of the latch mount 420.

Figure 20:
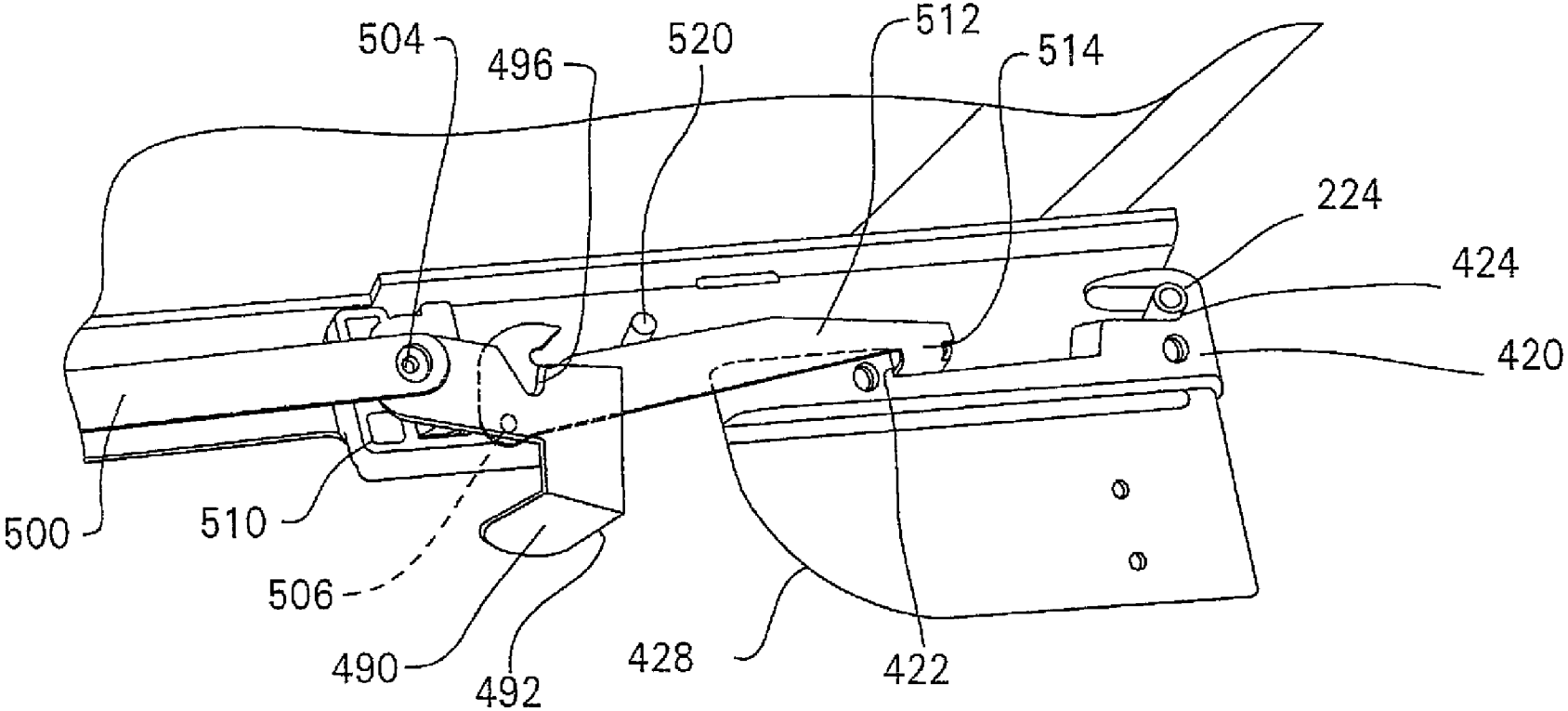
FIG. 20 is a partial cut-away view according to FIGS. 18-19 with the latch mechanism engaged.

In much the same fashion as the first embodiment described above, when the handle 482 is rotated counterclockwise, the link 500 will be pulled distally. As shown in FIG. 20, the carriage 510 will draw the locking arm 512 to the left and cause the pin 520 to drive the proximal end of the locking arm 512 downward. The locking hook 514 engages the catch 422 while drawing the foot section 450 against the patient support, fully engaging the sleeve 224 in the recess 424.

As the handle 482 is rotated distally, the back plate 536 of the cam bracket 530 contacts the bottom of the side rail 456 as the handle 482 reaches a horizontal position. The arrangement is configured such that when the handle 482 is in the horizontal position, the locking mechanism 480 is fully engaged with the sleeve 224 fully seated in the recess 424 and the removable foot section 450 closely drawn against the patient support.

Alternate Embodiment of FIGS. 21-24

Referring now to FIGS. 21-24, alternative locking mechanism embodiments 1180, 2180, 3180, 4180 are illustrated.

Figure 21:
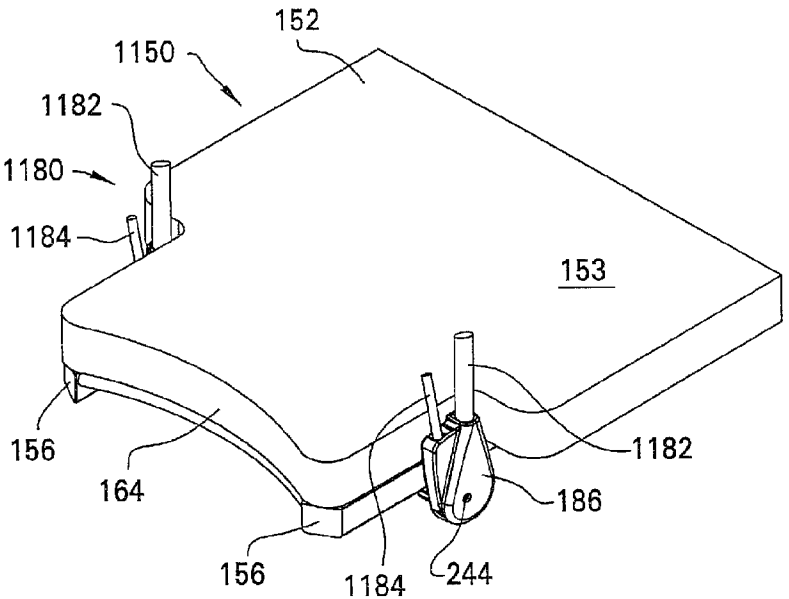

In FIG. 21, a removable foot section 1150 is provided with a locking mechanism 1180. The locking mechanism 1180 is provided on each side rail 156 and includes a main handle 1182 and a release lever 1184 projecting a short distance upwardly from each handle pivot assembly 186.

Figure 22:
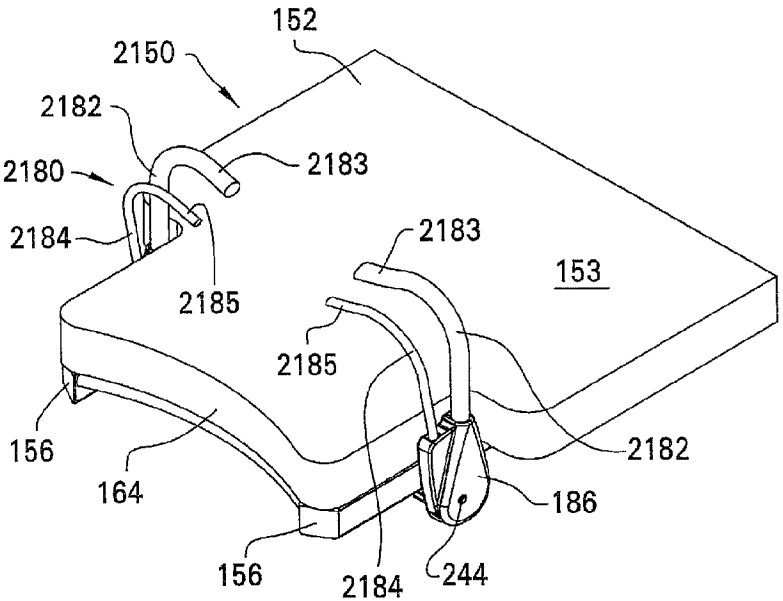
FIGS. 21-24 are perspective views of alternative handle configurations of the removable foot section of FIGS. 1-9.

In FIG. 22, a removable foot section 2150 is provided with a locking mechanism 2180 on each side rail 156. The locking mechanism 2180 comprises a main handle 2182 and a release lever 2184. The main handle 2182 includes an inwardly turned portion 2183, and the release lever includes an inwardly turned portion 2185, each inwardly turned portion 2183, 2185 extending over the upper surface 153 of the foot section pad 152. The inwardly turned portions 2183, 2185 lack a continuous bight portion therebetween.

Figure 23:
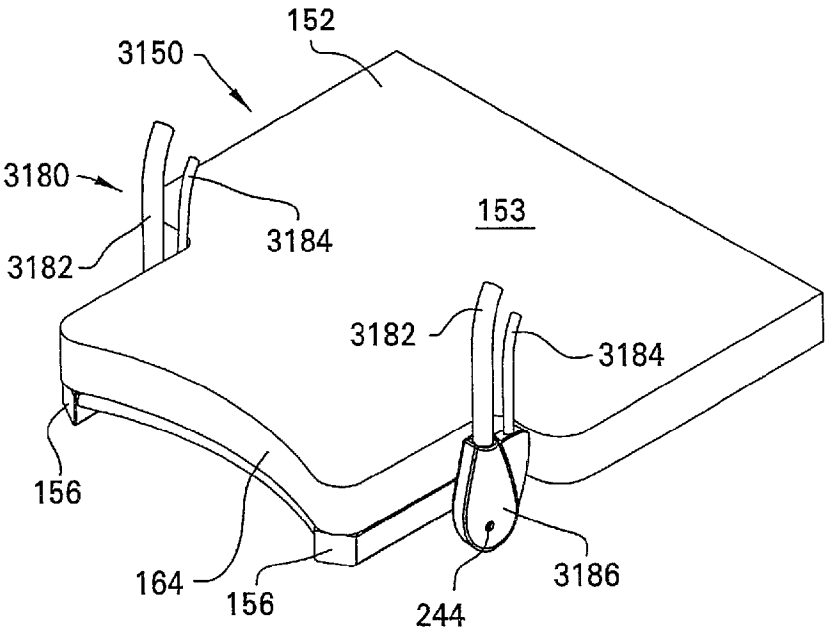

In FIG. 23, a removable foot section 3150 is provided with a locking mechanism 3180 on each side rail 156 having main handles 3182 and release levers 3184 pivotally connected in a handle pivot assembly 3186. The release lever 3184 is positioned proximally of the main handle 3182 for grasping by an operator. The main handles 3182 and the release levers 3184 curve proximally.

Figure 24:
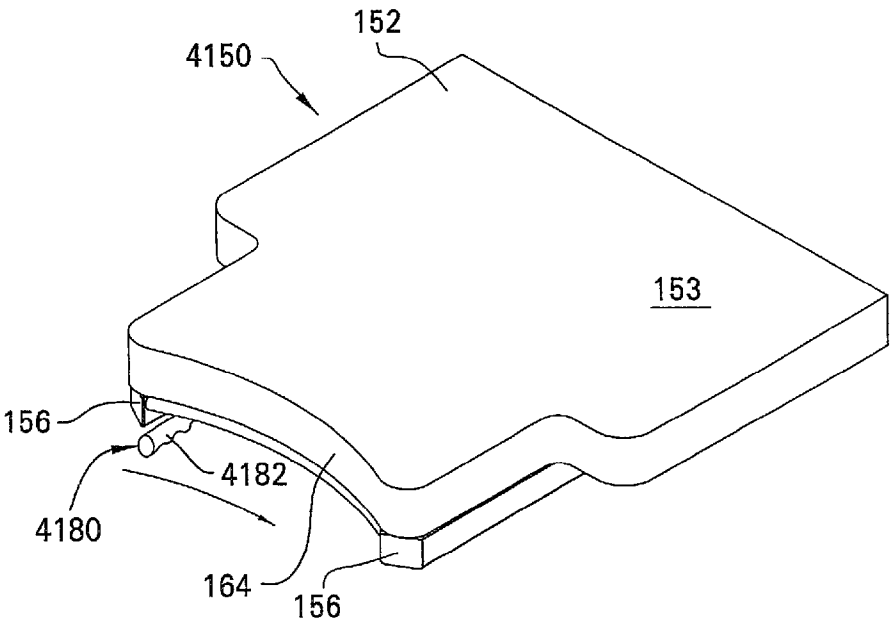

In FIG. 24, a removable foot section 4150 is provided with a locking mechanism 4180 comprising a main handle 4182. The main handle 4182 is pivotally or slidably mounted to the removable foot section between the side rails 156, and configured to release the locking mechanism 4180.

Although a particular preferred embodiment of the invention has been disclosed in detail for illustrative purposes, it will be recognized the variations or modifications of the disclosed apparatus, including the rearrangement of parts, lie within the scope of the present invention.

What is claimed is:

1. A patient support apparatus comprising:

a patient support including a first patient support deck;

a removable section having a second patient support deck, said removable section being configured for movement along a longitudinal axis to a first position wherein said removable section may be coupled to said patient support, a second position wherein said removable section is adjacent to but spaced from said first position, and a third position spaced apart from said patient support;

a latch mount on one of said patient support and said removable section;

a sensing mechanism configured to translate generally along the longitudinal axis, said latch mount configured to be contacted by said sensing mechanism when said removable section is moved to said second position, and said latch mount causing said sensing mechanism to translate along said longitudinal axis when said removable section is moved to said first position;

a latch mechanism mounted on the other of said patient support and said removable section and including a latch member; and wherein said sensing mechanism prevents said latch member from engaging said latch mount when said removable section is in said second position, and wherein said sensing mechanism permits said latch member to engage said latch mount when said removable section is moved to said first position.

2. The patient support apparatus according to claim 1, wherein said latch mount includes first and second recesses, said latch mechanism including first and second latch members, said first latch member being supported for movement relative to said second latch member, said first latch member being configured for reception into said first recess and said second latch member being configured for reception into said second recess.

3. The patient support apparatus according to claim 2, wherein said latch mount includes a third recess, said sensing mechanism configured for engaging said third recess.

4. The patient support apparatus according to claim 2, wherein said first latch member is supported for rotational movement relative to said second latch member.

5. The patient support apparatus according to claim 1, wherein said latch mount comprises at least one recess, and wherein said latch mechanism further comprises a release handle movably mounted on said removable section, said release handle being supported thereby for movement between a first handle position and a second handle position, whereby movement of said release handle from said first handle position toward said second handle position retracts said latch member from said at least one recess.

6. The patient support apparatus according to claim 5, wherein said release handle is configured to disengage said sensing mechanism from said latch mount to retract said latch member from said at least one recess.

7. The patient support apparatus according to claim 5, wherein said release handle is supported by said removable section for linear movement between said first handle position and said second handle position.

8. The patient support apparatus according to claim 1, wherein said sensing mechanism is configured for linear movement in response to said removable section being moved between said second position and said first position.

9. A patient support apparatus comprising:

a patient support;

a removable section;

a locking mechanism operable for releasably mounting said removable section to said patient support when said removable section is in an aligned position relative to said patient support, said locking mechanism including a latch mechanism configured to mount said removable section to said patient support; and wherein said locking mechanism further includes a sensing mechanism, said sensing mechanism movable from a blocking position wherein said latch mechanism is inhibited from mounting said removable section to said patient support to a non-blocking position wherein said latch mechanism is not inhibited from mounting said removable section to said patient support when said removable section is in said aligned position, wherein said latch mechanism is able to mount said removable section to said patient support only when said sensing mechanism is moved to said non-blocking position by moving said removable section to said aligned position.

10. The patient support apparatus according to claim 9, wherein said patient support includes a latch mount, said sensing mechanism moving to said non-blocking position in response to contact with said latch mount when said removable section is moved to align with said latch mount.

11. The patient support apparatus according to claim 10, wherein said latch mechanism includes a spring biased arm for engaging said latch mount, said spring biased arm operable to engage said latch mount when said removable section is in said aligned position.

12. The patient support apparatus according to claim 11, wherein said locking mechanism includes a pivotal handle, said pivotal handle being free to pivot and urge said spring biased arm into engagement with said latch mount when said sensing mechanism is moved to said non-blocking position and prohibited from pivoting until said sensing mechanism is moved to said non-blocking position when said removable section is in said aligned position.

13. The patient support apparatus according to claim 10, wherein said sensing mechanism comprises a sensing link, said sensing link being urged toward said latch mount by a biasing force when said removable section is moved toward said patient support, and said latch mount moves said sensing link against said biasing force when said removable section is moved to said aligned position.

14. The patient support apparatus according to claim 13, wherein said sensing link inhibits rotations of said handle until said sensing link is moved by said latch mount against said biasing force.

15. The patient support apparatus according to claim 9, wherein said sensing mechanism includes said sensing link, said sensing link being biased toward a surface of said patient support by a biasing force when said removable section is moved toward said patient support, and said surface moving said sensing link against said biasing force when said removable section is moved to said aligned position.

16. The patient support apparatus according to claim 15, further comprising an actuating handle, said actuating handle being free to actuate said locking mechanism when said sensing link is moved by said surface against said biasing force when said removable section is in said aligned position and prohibited from actuating said locking mechanism until said sensing mechanism detects said removable section is in said aligned position.

17. A method of mounting a removable section to a patient support of a patient support apparatus, said method comprising:

providing a latching mechanism for mounting the removable section to the patient support;

moving the removable section toward the patient support;

moving a sensing mechanism when the removable section is aligned with the patient support;

inhibiting with the sensing mechanism the latching mechanism from mounting the removable section to the patient support until said moving the sensing mechanism when the removable section is aligned with the patient support;

when the sensing mechanism is moved in response to aligning the removable section with the patient support, releasing the inhibiting of the sensing mechanism wherein the latching mechanism is actuatable to mount the removable section to the patient support; and when no longer inhibited by the sensing mechanism, actuating the latching mechanism to mount the removable section to the patient support.

18. The method according to claim 17, wherein said moving a sensing mechanism includes providing a sensing link and urging the sensing link toward a surface of the patient support with a biasing force, wherein the sensing link inhibits the latching mechanism from mounting the removable section to the patient support, and when the removable section is aligned with the surface of the patient support, moving the sensing link against the biasing force and thereby releasing said inhibiting.

19. The method according to claim 17, wherein when the latching mechanism is no longer inhibited by the sensing mechanism, said actuating the latching mechanism includes actuating the latching mechanism to engage the surface to thereby mount the removable section to the patient support.

* * * * *

UNITED STATES PATENT AND TRADEMARK OFFICE

CERTIFICATE OF CORRECTION

PATENT NO. : 7,735,168 B2
APPLICATION NO. : 12/193421
DATED : June 15, 2010
INVENTOR(S) : Richard A. Derenne and Christopher Gentile It is certified that error appears in the above-identified patent and that said Letters Patent is hereby corrected as shown below:

Column 7
Line 62, "aim" should be --arm--

Signed and Sealed this

Thirtieth Day of November, 2010

David J. Kappos

David J. Kappos
*Director of the United States Patent and Trademark Office*